US005355799A

United States Patent [19]

Lutz

[11] Patent Number: 5,355,799

[45] Date of Patent: Oct. 18, 1994

[54] APPLICATOR DEVICE FOR VISCOUS MATERIALS

[75] Inventor: Nölle Lutz, Weissenhorn, Fed. Rep. of Germany

[73] Assignee: Nolle GmbH, Fed. Rep. of Germany

[21] Appl. No.: 991,623

[22] Filed: Dec. 15, 1992

[30] Foreign Application Priority Data

Jan. 3, 1992 [DE] Fed. Rep. of Germany ..... 4200071
Nov. 26, 1992 [DE] Fed. Rep. of Germany ..... 4239793

[51] Int. Cl.[5] ..... B41F 31/06; B41L 27/08
[52] U.S. Cl. ..... 101/350
[58] Field of Search ..... 101/363, 364, 350, 365, 101/366, 207–210, 157, 169

[56] References Cited

U.S. PATENT DOCUMENTS 4,043,265 8/1977 Grebman ..... 101/363
4,186,661 2/1980 Vieau ..... 101/350
4,414,897 11/1983 Sato et al. ..... 101/350
4,432,282 2/1984 Jurinak ..... 101/350
4,542,693 9/1985 Mourrellone ..... 101/350
4,667,595 5/1987 Geretzki ..... 101/366
4,699,055 10/1987 Jeschke ..... 101/365
5,027,513 7/1991 Allison ..... 101/157 X

*Primary Examiner*—J. Reed Fisher
*Attorney, Agent, or Firm*—Banner, Birch, McKie and Beckett

[57] ABSTRACT

An applicator device is provided, particularly for solvent-containing and solvent-free UV printing inks, paints or adhesives onto a pattern roller of a flexographic printing machine, which receives the medium in recesses and transfers same to a high pressure roller. To avoid the occurrence of air bubbles in the medium to be applied and to press air out of the emptied recesses before they are filled again, a housing adapted to the lengths of the pattern roller and a dosing roller with elastic surface is provided above the contact line between the dosing roller and the pattern roller, which creates a chamber for accepting the medium located above the contact line of the two rollers and seals the chamber at all sides in a gas and air-tight manner.

16 Claims, 2 Drawing Sheets

APPLICATOR DEVICE FOR VISCOUS MATERIALS

The invention relates to an applicator device for viscous materials, in particular solvent-containing and solvent-free UV printing ink, paints or adhesives on a raster or pattern roller of a flexographic printing machine, which takes up the material in recesses and transfers it to a printing roller.

In particular, the invention relates to a doctor arrangement for such a flexographic printing machine.

In a flexographic printing machine, which for example is used to print web-like material such as paper, synthetics or the like, it has not previously been prevented that gas or air bubbles develop in the printing medium before application to the pattern roller, which however are to be absolutely avoided for quality printing. For example, a thin solvent ink for flexo-printing normally tends to foam, which is particularly enhanced in ink containers by stirring and by correspondingly large surfaces. It is not avoidable that in the known constructions, a continuous enrichment with air bubbles from the recesses of the pattern roller arises in the medium, for example in the printing ink.

The object of the present invention is therefore to structure an applicator device of the mentioned type, so that the occurrence of air bubbles in the inking medium is effectively prevented, thereby achieving a high printing quality, without the necessity of technically complex means.

In accordance with the invention, a housing is provided, adapted to the lengths of the pattern roller and a dosing roller and adapted to their partial circumference. The housing is provided above the contact line between the dosing roller and the pattern roller. It surrounds a chamber located above the contact line for receiving the medium and seals the chamber to all sides.

Further embodiments of the applicator device in accordance with the invention are defined in the claims 2 to 16.

The essential advantage of the applicator device in accordance with the invention is that it allows a thin film of medium to be produced, in particular a thin ink film on the dosing roller, and this ink film together with the surface of the dosing roller forces the air out of the at least partially emptied recesses of the pattern roller. The filled recesses are then submersed in the ink supply of the chamber, so that a foam or bubble formation in the chamber supply is not possible. In addition, a venting means can also be provided in the upper chamber region. It is also possible to completely relinquish a so-called immersion roller.

Further advantages of the invention will become apparent in the following description of embodiments in conjunction with the drawings.

Figure 1:
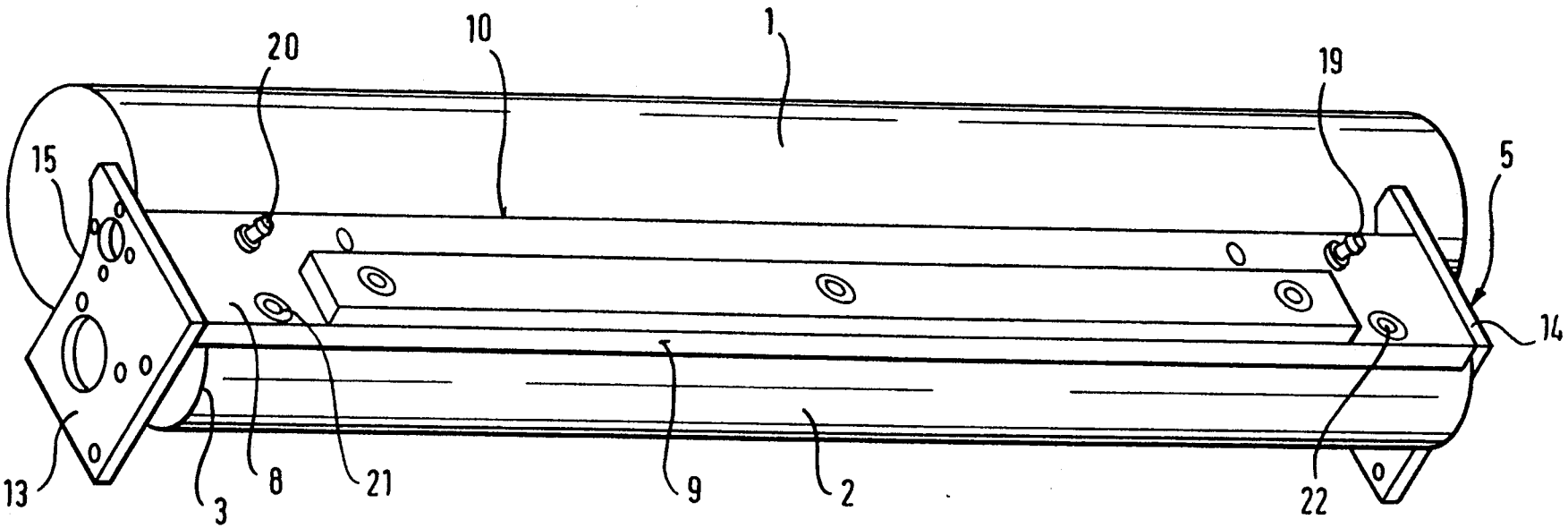
FIG. 1 shows a perspective of the applicator device as well as the pattern and dosing rollers.
Figure 2:
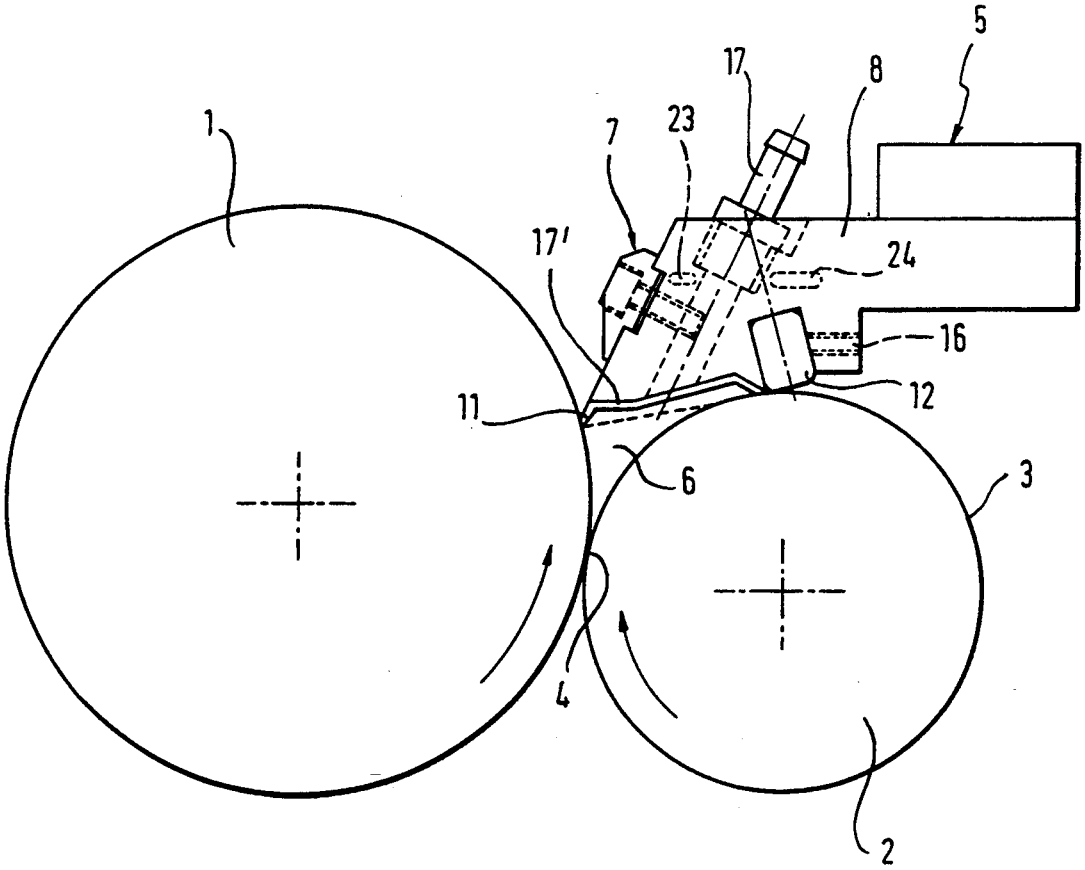
FIG. 2 shows a side view of the applicator device shown in FIG. 1.

An applicator device is shown in FIG. 2 in the form of a housing 5 arranged above a pattern roller 1 and a dosing roller 2. The pattern roller 1 comprises recesses (not shown) on its circumference, which receive a medium, in the shown embodiment a printing ink, and it transfers the medium to a high pressure roller (also not shown). The pattern roller 1 is one of the type with a ceramic surface and laser engraving, to transfer ink to the high pressure roller. Recess patterns can be exactly produced with such a laser engraving which can have a recess depth of less than 15 $\mu$m.

The dosing roller 2 has a mantle surface of rubber and consequently is elastic to a certain degree. The dosing roller 2 can, however, have a hard surface, preferably consisting of ceramic, anodized aluminum, chrome, steel or the like. The two rolls are driven independent of one another, whereby the drive speeds are the same. Naturally, it is also possible to adjust the separate drives for the two rollers so that for example the dosing roller 2 rotates with a higher speed or a lower speed than the pattern roller 1.

The two rolls contact each other in the region of the contact line 4 along a line or a slight surface. A chamber 6 for receiving the ink to be transferred to the high pressure roller is provided above this contact line 4 as can be seen in FIG. 2.

This chamber is enclosed by the housing 5 with its doctor arrangement, on the one hand, and by the circumference of the rollers 1, 2 neighboring it, on the other hand, so that entry of air into the chamber causing bubble formation in the medium is not possible.

The housing 5 of the doctor arrangement for sealing this chamber 6 against the outside comprises essentially a plate formed of an aluminum profile and can be connected to a tempering medium, preferably water, by means of the openings 21 and 22, so that the housing and therefore its surroundings can be brought to a desired temperature and also the temperature of the ink can be influenced. This ink is introduced into the chamber 6 via a feed port 19 and is removed by means of a discharge port 20 from the housing. The feed and discharge of the ink for the chamber 6 takes place continuously or intermittently in circulation by means of a pump (not shown), depending on the amount of ink to be filled or dosed.

The aluminum profile plate 8 of the housing 5 comprises channels 23, 24 connected or not connected to one another, which are provided so that hot or cold water as a tempering fluid can flow through the housing. The water, fed by means of a pump (not shown), flows into the housing 5 via an inlet 21 and leaves the housing via an outlet 22.

The two longitudinal edges 9, 10 of the plate 8 of the housing 5 comprise a doctor blade 11 as well as doctor bar 12. Both doctor means contact the associated roller 1 or 2 over the entire length. While the doctor blade 11 is shown in FIG. 2, it is also possible to provide two such doctor blades. Essential is that the doctor blade 11 has a positive or a negative engagement angle with respect to the pattern roller 1, which is adjustable by means of a set screw 7.

The doctor means 12 engaging the dosing roller 2 with the rubber covering 3 is formed as a doctor bar. The doctor pressure on the dosing roller 2 is adjustable to regulate the printing ink by adjusting the doctor bar 12 with the mechanical means 16. The doctor bar 12 is also arranged in positive or negative angle relationship to the dosing roller.

If the dosing roller is provided with a hard surface covering or if it comprises a hard surface itself, the same is formed of chrome, steel, ceramic or an aluminum material surface treated by means of anodic oxidation, as mentioned above, then the doctor bar is replaced by a doctor in the form of a blade of hard plastic or steel, which engages the dosing roller at an angle opposing its rotational direction, i.e. contacts the latter at a negative angle. The doctor pressure onto the dosing roller in this case is also variable.

The two end plates 13 and 14 secured to the housing 5 and arranged on the two end faces of the dosing roller 2 provide for side enclosure of the chamber 6 along with the sealing 17' (FIG. 2) of elastic sealing material. The two side plates 13, 14 are each secured to a holding means (not shown), so that the applicator device as such can be rotated away from the rollers or completely removed for the purpose of service or cleaning.

As shown in FIG. 2, an adjustment axis 127 is provided on the housing 5 by means of which the applicator device can be adjusted in step-less manner in substantially vertical direction with respect to the rollers 1, 2. An adjustment means (not shown) additionally provides for a setting of the housing in a direction parallel to the plane of the roller axis.

As mentioned above, the dosing roller 2 with its rubber cover 3 or with a hard surface layer can be driven at the same speed, faster or slower than the running speed of the pattern roller 1, for example depending on the form of the recesses in the pattern roller 1 and the viscosity of the ink applied to the roller. In addition, the Shore hardness of the dosing roller is the same or smaller than that of the high pressure cylinder. The dosing roller can be driven in that it is formed as a hollow body and the inner wall comprises gear teeth on its circumference, with which the outer teeth of a gear arranged inside the dosing roller engage. A further description of the driving means is unnecessary, since the possible further drive mechanisms of the pattern roller 1 and the dosing roller 2 are known per se.

In operation, the two rollers 1 and 2 rotate in the direction of the arrows in FIG. 2. An ink film adjustable in its thickness by the doctor bar is present on the surface of the dosing roller 2 after having passed the doctor bar 12, which together with the rubber cover 3 of the dosing roller presses the air out of the emptied recesses (not shown) of the pattern roller 1 through contact with the pattern roller 1, whereby these recesses are largely filled with ink and then enter into the ink supply of the chamber 6.

The same effect of pressure causing the emptying of the recesses and their filling with ink also results when the dosing roller comprises a hard or rigid surface.

With this, it is not possible that air is taken up in the partially or completely emptied recesses, which reach the chamber 6 when the corresponding sections of the two rolls 1, 2 move beyond the contact line 4 into the chamber 6. The doctor blade 11 removes excess ink from the pattern roller 1, so that the latter can supply the high pressure is roller of the flexographic printing machine with a certain amount of ink.

As shown in the drawing and discussed above, the formation of foam in the ink supply inside of the chamber 6 is effectively avoided, without the necessity of complicated equipment. The embodiment of the applicator device further has the special advantage that it can be fitted to existing flexographic printing machines. In particular, it can be retro-fitted into a flexographic printing machine and easily removed.

I claim:

1. Applicator device for a viscous medium of a flexographic printing machine comprising a pattern roller with recesses which take up a viscous medium and transfer it to a high pressure roller, a dosing roller engaging said pattern roller along a contact line, and a housing having the same length as the pattern roller (1) and the dosing roller (2), said housing being provided above the contact line (4) which extends between the dosing roller(2) and the pattern roller (1), said housing, said pattern roller and said dosing roller creating and surrounding a chamber (6) located above the contact line (4) of said pattern roller and said dosing roller (1, 2) for receiving the viscous medium, said housing cooperating with said pattern roller and said dosing roller to seal the chamber on all sides in a gas-tight and an air-tight manner.

2. Applicator device of claim 1 in which the housing comprises a plate (8) which has opposing longitudinal edges (9, 10) and an end plate (13, 14) on each end and fixed thereto, each said end plate has a contour and is mounted so that side leakage of the viscous medium out of the ends of the chamber is excluded, and in which said device further includes doctor means (11, 12) which are adjustably mounted to extend downwardly from said plate to be in contact with one of the pattern roller (1)or the dosing roller (2).

3. Applicator device of claim 2 in which the end plates (13, 14) each include an end surface (15) which generally conforms with the outer diameter or curvature of the pattern roller (1).

4. Applicator device of claim 1 in which the housing (5) has the capacity to rotate away from the pattern roller and the dosing roller (1, 2).

5. Applicator device of claim 1 in which the dosing roller (2) comprises a rubber coating (3) capable of accepting and transporting the viscous medium in the form of a film, and which presses the air out of the recesses of the pattern roller.

6. Applicator device of claim 1 in which the dosing roller (2) comprises a hard surface capable of accepting and transporting the viscous medium in the form of a film.

7. Applicator device of claim 6 in which the hard surface of the dosing roller (2) is composed of one of ceramic, chrome, steel, or anodized aluminum.

8. Applicator device of claim 6 or 7 in which the hard surface of the dosing roller (2) comprises a rastering.

9. Applicator device of claim 6 or 7 further including doctor means engaging the dosing roller, said doctor means being formed as a doctor blade, said doctor blade being composed of one of plastic or steel and engaging the dosing roller at an adjustable angle opposed to its rotational direction.

10. Applicator device of claim 1 further including doctor means engaging the dosing roller (2),said doctor means being formed as a doctor bar (12), and an adjustment mechanism for adjusting said doctor bar in a positive or negative angular position to the dosing roller and for adjusting the pressure of the doctor bar onto the dosing roller (2).

11. Applicator device of claim 1 further including doctor means formed as a doctor blade (11) and a setting means for adjusting said doctor blade in a positive or negative angular position with respect to the pattern roller (1).

12. Applicator device of claim 1 in which the housing comprises a supply opening (19) and a discharge opening (20) for the viscous medium, and a supply opening, a discharge opening and passages (23, 24)for a tempering medium so that the housing and its surroundings are heatable or coolable.

13. Applicator device of claim 2 in which said dosing roller includes a frame and a central rod, and in which each end plate (13, 14)secured to the respective ends of the plate (8) is fixed to the frame of the dosing roller (2) whereby the two end plates (13, 14) are connected to one another by a rod for stabilization.

14. Applicator device of claim 1 further including means for driving the dosing roller (2) at a speed which is the same, greater or smaller than the speed of the pattern roller (1).

15. Applicator device of claim 1 in which the pattern roller (1) is provided with a ceramic surface and a laser engraving for transferring the viscous medium to the high pressure roller.

16. Applicator device of claim 1 in which the dosing roller (2)is formed as a rubber roller which has a Shore hardness which is the same or less than that of the high pressure roller.

* * * * *